United States Patent [19]

Shaffer

[11] Patent Number: 4,735,575

[45] Date of Patent: Apr. 5, 1988

[54] ELECTRICAL TERMINAL FOR PRINTED CIRCUIT BOARD AND METHODS OF MAKING AND USING SAME

[75] Inventor: Howard R. Shaffer, Millersburg, Pa.

[73] Assignee: AMP Incorporated, Harrisburg, Pa.

[21] Appl. No.: 915,831

[22] Filed: Oct. 6, 1986

[51] Int. Cl.[4] ..... H01R 13/428

[52] U.S. Cl. ..... 439/82; 439/751

[58] Field of Search ..... 339/17 C, 220 R, 221 R, 339/221 M, 252 R, 252 P, 258 RR; 439/82, 84, 751, 825, 826, 827, 869, 873

[56] References Cited

U.S. PATENT DOCUMENTS

| | | | |
|---|---|---|---|
| 2,925,577 | 2/1960 | Cetran et al. | 339/220 R |
| 3,440,597 | 4/1969 | Baker, II et al. | 339/221 R |
| 4,428,642 | 1/1984 | Schwindt et al. | 439/885 |
| 4,464,009 | 8/1984 | Thaler | 439/816 |
| 4,475,780 | 10/1984 | Walter et al. | 439/82 |

FOREIGN PATENT DOCUMENTS

| | | | |
|---|---|---|---|
| 2049739 | 4/1972 | Fed. Rep. of Germany | 339/252 P |
| 8431966 | 5/1986 | Fed. Rep. of Germany . | |

*Primary Examiner*—Gil Weidenfeld
*Assistant Examiner*—Gary F. Paumen
*Attorney, Agent, or Firm*—Anton P. Ness

[57] ABSTRACT

A contact terminal for insertion into a plated through-hole of a printed circuit board is formed from thin metal stock of uniform thickness with a tubular compliant mounting section. A plurality of spring vanes are spaced around the mounting section and extend tangentially outwardly to be deflected radially inwardly by the plated through-hole when inserted, to mechanically secure the terminal therein. Outer edges on the free ends of the spring vanes penetrate the plating material during insertion. A method for making such a terminal includes piercing the mounting portion area of the blank, forming slits therein, and rolling at least that portion into a tubular shape so that short tab-like metal portions extend tangentially outwardly to become the spring vanes.

16 Claims, 3 Drawing Sheets

ELECTRICAL TERMINAL FOR PRINTED CIRCUIT BOARD AND METHODS OF MAKING AND USING SAME

FIELD OF THE INVENTION

The present invention relates to electrical contact terminals and more particularly to terminals for connection to printed circuit boards.

BACKGROUND OF THE INVENTION

Electrical contact terminal posts are known which can be electrically connected to printed circuit boards by insertion through plated through-holes of a board and secured therein without solder. Such terminal posts have compliant mounting sections therealong which bear against and are spring biased inwardly by the plated walls of the through-holes, where the spring force is high enough that assured mechanical gripping is maintained, as well as assured electrical connection being established.

Terminal posts such as those of U.S. Pat. No. 4,186,982 are formed from solid bar stock having a square cross-section of standard size, usually 0.025" square or 0.045" square. Those of U.S. Pat. Nos. 4,017,143; 4,076,356; 4,166,667; 4,191,440; and 4,381,134 have solid post contact sections and adjacent C-shaped compliant mounting sections formed of thinner metal stock than that of the post contact sections, requiring a milling operation prior to stamping the blank. The C-shaped section offers spring characteristics which are enhanced by reducing the thickness of the arms of the C-shape.

Protuberances are sometimes used along the C-shaped compliant mounting sections to break through surface oxides on the plating material for good electrical connection, as disclosed in U.S. Pat. No. 3,783,433. Axially extending ridges or ribs are used in U.S. Pat. No. 4,076,356 to actually penetrate into the plating material as also taught in U.S. Pat. Nos. 3,416,122 and 4,186,982.

It is desirable to form a terminal from relatively thin sheet metal stock of uniform thickness to reduce the metal content of the terminal and facilitate creating desired contact section structures on an end thereof, and eliminate the necessity of milling operations.

It is further desirable to form such a terminal to have protuberances to establish an assured electrical connection with the internal surface of a plated through-hole.

SUMMARY OF THE INVENTION

A terminal post of the present invention is formed from a blank stamped from thin sheet metal stock having a uniform thickness such as 0.008 inches. In the intermediate portion of the blank to become the compliant mounting section, a plurality of axial slits are punched therein by a die piercing the blank. In one case the metal on one side of each slit is pushed out of the plane of the blank to a selected limited extent, while the metal on the other side is undeformed; In another case the axial slits have end portions extending on the same side in non-axial directions a limited extent defining a wide short tab section. Preferably the several slits of a blank and their adjacent areas are identical from slit to slit. Then when at least the intermediate portion of the terminal is formed into a tubular shape, the resultant compliant mounting section contains a plurality of parallel vanes spaced around the circumference and extending outwardly and substantially tangentially in a common direction either clockwise or counterclockwise to free ends having sharp outer edges. The outer edges define an effective diameter larger than the general diameter of the compliant mounting section. Upon press-fit insertion of the compliant mounting section into a plated board through-hole having a diameter smaller than the effective diameter, the vanes act as springs to be deflected slightly radially inwardly and maintain a spring force outwardly against the internal surface of the hole to mechanically secure the terminal therein. The outer edges penetrate the plating material during insertion which both establishes an assured electrical connection by breaking through the oxide layer and minimizes overdeflection of the spring vanes.

According to one aspect of the invention, a terminal for mounting in a board through-hole is formed from a thin metal blank of uniform thickness and has at least a tubular compliant mounting section having walls of uniform thickness.

According to another aspect of the invention the compliant mounting section of such a terminal has a plurality of circumferentially spaced axially disposed vanes which simultaneously act as spring means for mechanical gripping and as penetration means for assured electrical connection. The spring vanes may be angled slightly at their leading ends to first engage the internal surface of the through-hole and to assist in initiating the deflection of the spring vanes during insertion, when the compliant mounting section's larger effective diameter engages the through-hole surface. Their trailing ends may be angled sharply from the axial direction to resist withdrawal upon rearward stress being applied to the terminal.

According to a further aspect of the invention, portions of the metal blank on one side of each slit may be pushed outward from the plane of the blank while the metal on the other side is undeformed, which creates more pronounced outwardly extending projections on one side of each slit when the blank is formed into a tubular shape at least at the compliant mounting portion which projections are deflectable inwardly during insertion to comprise spring members.

According to still another aspect of the invention, the terminal may have one or both ends formed into a pin contact section, a socket contact section, or a wire-wrap post as taught in U.S. Pat. No. 3,420,087.

DETAILED DESCRIPTION OF THE PREFERRED EMBODIMENT

Figure 1:
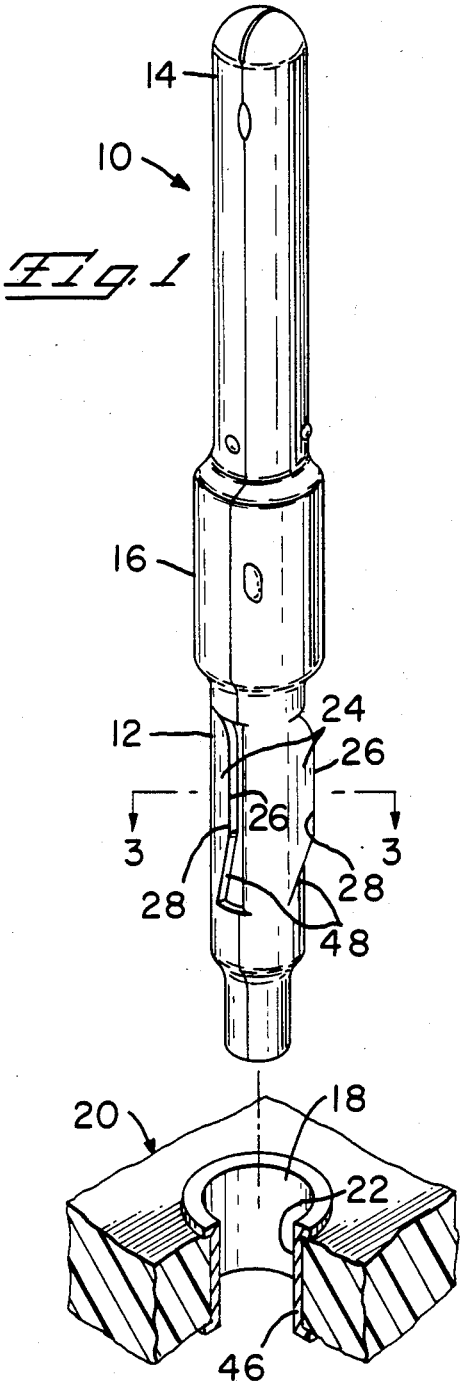
FIG. 1 is a perspective view of a terminal of the invention prior to insertion into a board through-hole.

A contact terminal 10 is shown in FIG. 1 which has a compliant mounting section 12, a pin contact section 14, and a retention section 16 which would provide for retention in a dielectric housing (not shown). Pin contact section 14 is conventional and would mate with a conventional socket contact (not shown). Compliant mounting section 12 is insertable into a plated through-hole 18 of a printed circuit board 20 to secure terminal 10 to board 20 by mechanically gripping internal surface 22 of through-hole 18 and simultaneously establishing electrical connection therewith. A plurality of vanes 24 are spaced around the circumference of compliant mounting section 12 between tubular end portions of mounting section 12 which end portions remain integrally joined by axially extending portions. Vanes 24 extend tangentially outwardly therefrom preferably in a common direction either clockwise or counterclockwise, each to free end 26 having a relatively sharp outer edge 28. Sharp edges 28 collectively define an effective diameter larger than the general diameter of compliant mounting section 12 and larger than the inside diameter of plated through-hole 18. A plurality of terminals 10 can be secured in a housing to result in a connector such as a Metrimate connector manufactured by AMP Incorporated, Harrisburg, PA which is mountable to a printed circuit board.

Figure 2:
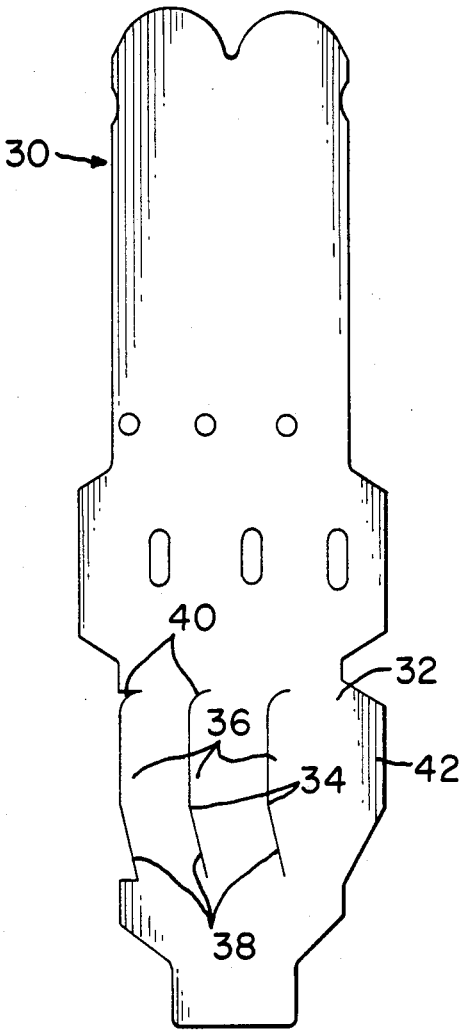
FIG. 2 is a plan view of a stamped terminal blank prior to forming.

FIG. 2 illustrates a blank 30 stamped from a strip of relatively thin sheet metal such as brass which has a uniform thickness of for example 0.0125 inches. Portion 32 of blank 30, which will become the compliant mounting section of the finished terminal, is pierced by a die at slits 34; and the metal portions 36 between slit end points near ends of mounting section 12 and along a common side of slits 34 will define the vanes of the invention. Preferably the leading ends 38 of slits 34 are angled slightly from axial to facilitate insertion of the finished terminal into a through-hole. Trailing ends 40 of slits 34 are curved sharply to extend substantially normally a small distance from the axial portion of slits 34 to enable metal portions 36 to become short tab-like spring vanes 24 when the compliant mounting section 12 is created by tubular shaping of blank portion 32. A lateral tab 42 may be formed on blank 30 parallel to slits 34 which will be bent normally outwardly of the plane of the blank in the direction which will comprise the inside of the tubular compliant mounting portion.

Figure 3:
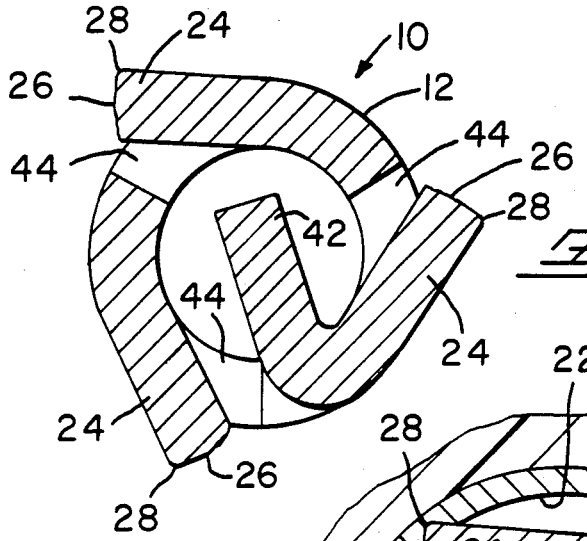
FIG. 3 is a cross-sectional view of the compliant mounting section taken along lines 3—3 of FIG. 1.

FIG. 3 is a cross-section of compliant mounting section 12 of terminal 10 formed from blank 30. Free ends 26 of vanes 24 extend tangentially outwardly when blank 30 is formed into a tubular shape by conventional forming, creating vacancies 44 radially inwardly from free ends 26 of vanes 24. Lateral tab 42 extends into the center of the tubular compliant mounting section 12 which increases the current-carrying capability of compliant mounting section 12 and also provides increased strength therein; this is especially important in smaller diameter terminals.

Figure 4:
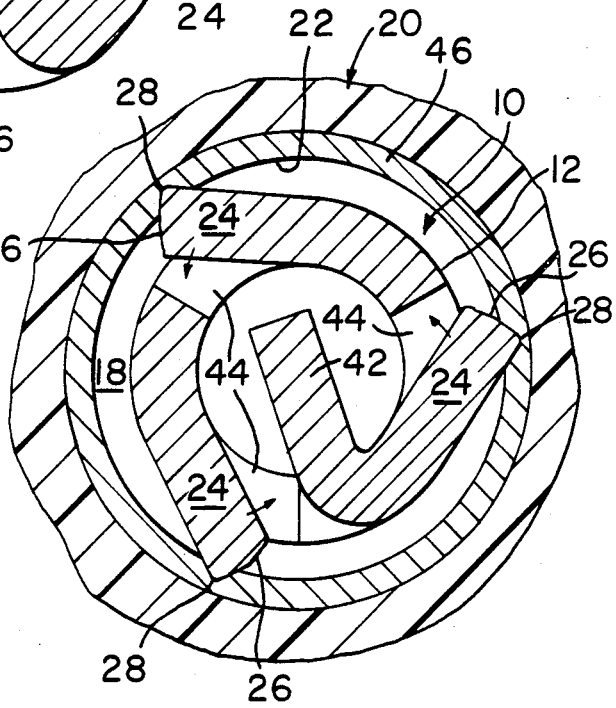
FIG. 4 is a cross-sectional view similar to FIG. 3 after insertion into a plated through-hole.

As shown in FIG. 4, force-fit insertion of compliant mounting section 12 into plated through-hole 18 results in slight deflection of vanes 24 radially inwardly into vacancies 44 by the internal surface 22 of the hole. Vanes 24 act as springs by comprising short wide tab-like cantilever arms which apply radially outward spring force against internal surface 22. Edges 28 are sharp enough (even if optionally deburred or coined) to penetrate into the plating material 46 during axial insertion of terminal 10 into hole 18, which break through the oxide layer which commonly forms on the plating material; this results in an assured electrical connection with the conductive plating material underneath the oxide layer. Such penetration also is believed to serve to minimize overdeflection of vanes 24 which could cause overstress, and also to serve to resist withdrawal of terminal 10 if axially rearward force is applied thereon. Referring to FIG. 1, it can be seen that leading ends 48 of vanes 24 resulting from leading slit ends 38 in FIG. 2 extend at first only minimally outwardly from the generally tubular outer surface of compliant mounting section 12 and then increasingly outwardly proceeding axially therealong. During axial insertion leading ends 48 begin to engage internal surface 22 gradually which initiates the deflection of vanes 24.

Figure 5:
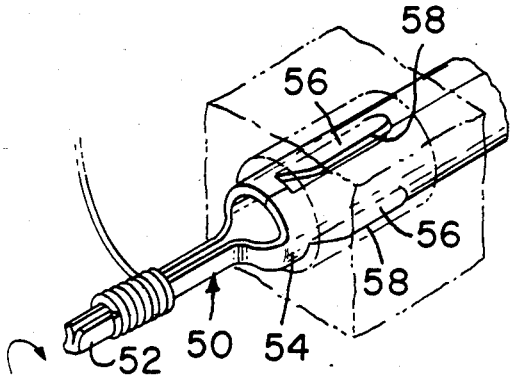
FIG. 5 is an alternate embodiment of the present invention with a wire-wrap terminal post contact section.

Reference to FIG. 4 also demonstrates that forwardly facing surfaces of free ends 26 of vanes 24 would resist rotation of terminal 10 in hole 18 in the particular direction vanes 24 extend because outer edges 28 would dig into plating material 46. This is beneficial for terminals which would be subjected to torque during or after insertion. FIG. 5 illustrates a terminal 50 having a wire-wrap post section 52 outwardly from compliant mounting section 54. Such a post section 52 can be formed by severely coldworking a U-shaped channel formed in the blank from which terminal 50 is made, as taught in U.S. Pat. No. 3,420,087 and in U.S. patent application Ser. No. 701,819 filed Feb. 19, 1985. If the conventional wrapping of wire is performed in the same direction as vanes 56 are disposed, the resultant induced torque will not succeed in causing rotation of the terminal in the plated through-hole because free ends 58 of vanes 56 will tend to bite into the plating material.

Figure 6:
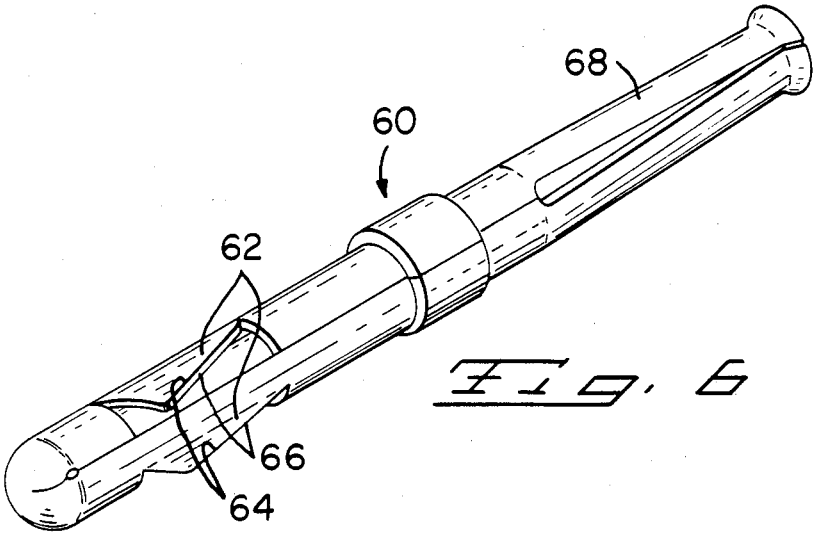
FIG. 6 is an alternate embodiment of the present invention with a socket contact section.

FIG. 6 illustrates an alternate embodiment of the spring vanes of the present invention. Terminal 60 has vanes 62 which are substantially disposed at an angle to the axial direction therealong, with the trailing ends 64 thereof normal to axial. While insertion into a plated through-hole would be facilitated as described in reference to leading ends 48 of FIG. 1, withdrawal would tend to be resisted by edges 66 tending to dig into the plating material when axially rearward force is applied on the terminal. Also illustrated in FIG. 6 is a socket contact section 68 whose features are conventionally known with stamped and formed contact terminals.

Figure 7:
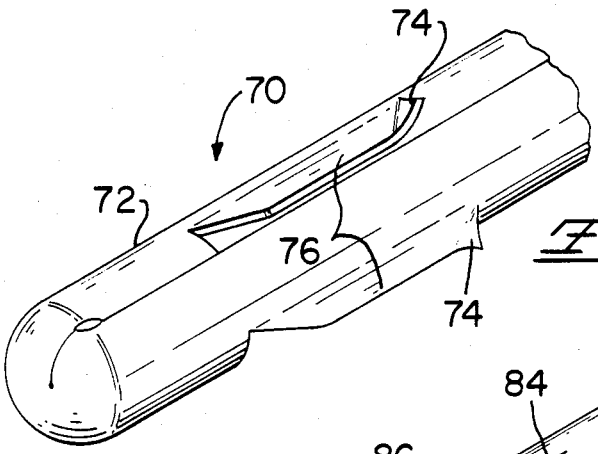
FIGS. 7 and 8 are alternate embodiments of the compliant mounting portion of the present invention.

FIG. 7 shows a variation on the present invention to resist withdrawal after insertion. Terminal 70 has a compliant mounting portion 72 wherein the trailing ends 74 of vanes 76 are pushed slightly out of the plane of the blank after the slits are pierced into the blank. Upon tubular shaping, vanes 76 will extend tangentially outwardly from portion 72 similarly to vanes 24 of FIGS. 1 to 4 but trailing ends 74 will extend farther radially outwardly, and will tend to penetrate into the plating material to resist withdrawal.

Figure 8:
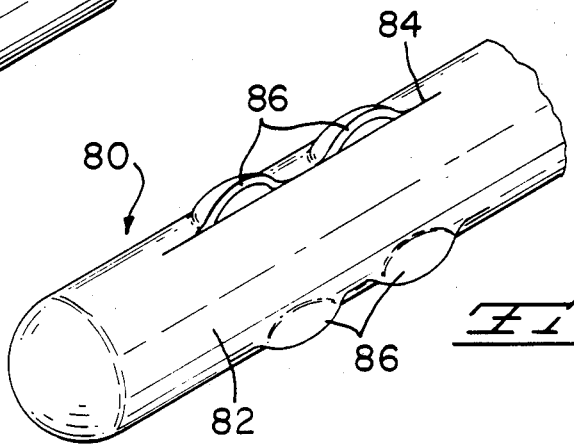

FIG. 8 exhibits an alternate embodiment of the present invention using straight slits pierced into a blank while still resulting in spring members deflectable radially inwardly upon insertion into a plated throughhole. Compliant mounting portion 82 of terminal 80 has axially extending slits 84 therealong. On a selected side of each slit 84, the metal portion of the blank has been deformed to push outwardly one or preferably two half-dimples 86 spaced inwardly from the ends of the slit, while the metal portion on the opposite side of the slit is undeformed. The outermost extent of half-dimples 86 defines the effective diameter of compliant mounting portion 82 greater than the inside diameter of the plated throughhole into which terminal 80 will be inserted. Upon insertion, half-dimples 86 will be together deflectable inwardly and act as spring members or vanes because of extended slits 84. Two such half-dimples 86 with each slit 84 tend to stabilize terminal 80 after mounting.

The present invention provides an effective compliant mounting section on a contact terminal for insertion into a plated through-hole of a printed circuit board, in a stamped and formed terminal made from thin sheet metal not requiring any milling or skiving operation to vary the thickness of the metal. A variety of contact sections can be formed integrally therewith at one or both ends of the terminal as desired including pin sections, socket sections, and wire-wrap posts; provided, of course, that at least one end be insertable through the plated through-hole. Three spring vanes are adequate although two or more than three may be used, and the particular contour or orientation thereof can be varied. Other modifications may be made to the present invention as desired, within the spirit of the invention and the scope of the claims.

What is claimed is:

1. A contact terminal for insertion into a socket means of a printed circuit board, the socket means having an internal surface of selected diameter, said terminal comprising:

a member having at least one contact section means at an end thereof, and further having:

a generally tubular compliant mounting section intermediate the ends of said member and having tubular portions at each end of said mounting section having a common outer diameter less than the selected diameter of the inside surface of the socket means, said tubular portions being integrally joined by axially extending portions of said mounting section, said mounting section further having a plurality of substantially axial spring vanes disposed between said tubular portions and spaced circumferentially around said mounting section each extending generally tangentially outwardly from a respective said axially extending portion to a free end having an outermost edge, said outermost edges together defining an effective diameter greater than said selected diameter of said internal surface of said socket means, said spring vanes adapted to be deflected radially inwardly upon insertion into said socket means, said spring vanes including leading ends each beginning at a point on the surface of said generally tubular compliant mounting section and gradually extending outwardly proceeding axially along said compliant mounting section from said point, forming lead-ins assisting deflection of said spring vanes during insertion into said socket means.

2. A contact terminal as set forth in claim 1 stamped and formed from a thin metal sheet of uniform thickness.

3. A contact terminal as set forth in claim 1 wherein said free ends of said spring vanes are generally oriented at a selected angle from the longitudinal axis of said terminal.

4. A contact terminal as set forth in claim 1 wherein said spring vanes extend tangentially outwardly in a common angular direction about the circumference of said compliant mounting section, resistant to rotation in said direction after insertion.

5. A contact terminal as set forth in claim 1 wherein said spring vanes comprise radially outward projections extending to said free ends and formed on first sides of respective axial slits, and metal comprising second sides of said slits remains undeformed.

6. A contact terminal as set forth in claim 1 wherein said compliant mounting section includes an axially extending tab section extending radially inwardly from a side edge of a said axially extending portion.

7. A contact terminal as set forth in claim 1 wherein a said at least one contact section means is a pin section.

8. A contact terminal as set forth in claim 1 wherein a said at least one contact section means is a socket section.

9. A contact terminal as set forth in claim 1 wherein a said at least one contact section means is a wire-wrap post section.

10. An electrical connection of a contact terminal in a conductive socket means of a printed circuit board, said socket means having an internal surface of selected diameter and said contact terminal having a generally tubular compliant mounting section having tubular portions at each end of said mounting section having a common outer diameter less than said selected diameter of said socket means, said tubular portions being integrally joined by axially extending portions of said mounting section, said mounting section further having a plurality of substantially axial spring vanes each extending generally tangentially outwardly from a said axially extending portion to a free end having an outermost edge, said outermost edges together defining an effective diameter larger than said selected diameter such that said outermost edges penetrate the side wall of said socket means, and said free ends of said spring vanes are deflected radially inwardly by said internal surface thereof and apply a radially outward spring force thereagainst securing said compliant mounting section in said socket means, whereby said contact terminal is secured to said printed circuit board without solder and assured electrical connection thereto is achieved.

11. A method of making a contact terminal suitable for insertion into a socket means of a printed circuit board and mechanically self-retaining therein in electrical engagement therewith, comprising the steps of:

selecting a sheet of metal of uniform thickness;

stamping a terminal blank therein having opposed end portions defining a longitudinal direction therebetween;

piercing a selected portion of said blank intermediate said blank end portions at a plurality of locations to form slits therealong substantially parallel to said longitudinal direction, said slits being formed between respective pairs of slit end points spaced from ends of said selected blank portion, each slit having at least ends thereof at respective selected angles from said longitudinal direction such that the remainder of said slit between said ends is laterally offset from said slit end points;

forming at least said selected portion into a tubular shape having an axis parallel to said longitudinal direction such that said tubular shape includes axially extending portions between adjacent ones of said slit end points, and a part of each said axially extending portion between the angled ends of each slit extends generally tangentially outwardly from a respective side edge of the remainder of said axially extending portion to a free end comprising a spring member deflectable radially inwardly by a socket means of a printed circuit board upon insertion of said terminal thereinto said remainder of each said axially extending portion being of arcuate cross-section;

forming at least one said blank end portion into a contact section.

12. The method as set forth in claim 11 wherein said ends of all said slits extend in a common direction so that when said selected portion is formed into said tubular shape, said free ends extend tangentially outwardly in the same angular direction.

13. The method as set forth in claim 11 wherein the ends of all said slits at a selected end of said selected portion of said blank are disposed at a slight said selected angle, such that when said selected portion of said blank is formed into said tubular shape, said outermost edges of said tangentially extending metal portions extend gradually outwardly from respective points on the surface of said tubular shape and define an edge surface angled slightly toward said selected end of said selected blank portion.

14. The method as set forth in claim 11 wherein at least one end of each said slit is curved sharply to define a slit end portion extending substantially normally a selected small distance from a substantially axial portion thereof.

15. The method as set forth in claim 11 further including the step of forming a lateral tab portion along said selected portion of said blank and bending said lateral tab portion normally from the plane of said blank such that when said tubular shape is formed, said lateral tab portion extends radially inwardly.

16. A method of making an electrical connection between a plated through-hole of a printed circuit board and a terminal post mounted therein, comprising the steps of:

forming a tubular mounting portion of a terminal, said tubular mounting portion having parallel, axially extending spring vanes extending tangentially outwardly in a common angular direction from the circumference of said tubular mounting portion to free ends deflectable radially inwardly, said free ends including outermost edges defining an effective diameter;

forming a terminal post section at at least one end of said terminal;

inserting said mounting portion into a plated through-hole having an inside diameter less than said effective diameter such that said spring vanes are deflected radially inwardly thereby securely gripping said internal surface and said outermost edges penetrate the plating material of said through-hole in electrical connection therewith, and such that said terminal post section extends outwardly from said printed circuit board; and wrapping wire around said terminal post section in said angular direction, whereby said free ends of said spring vanes resist rotational movement in said angular direction urged by said wire wrapping.

* * * * *